US006644775B2

(12) United States Patent
Murcia et al.

(10) Patent No.: US 6,644,775 B2
(45) Date of Patent: Nov. 11, 2003

(54) SINGLE ACTUATION AXIS PRINTHEAD CLEANER ARCHITECTURE FOR STAGGERED PRINTHEADS

(75) Inventors: Antoni S. Murcia, San Diego, CA (US); Ted T. Lee, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/978,483

(22) Filed: Oct. 16, 2001

(65) Prior Publication Data

US 2003/0071870 A1 Apr. 17, 2003

(51) Int. Cl.[7] ..... B41J 2/165
(52) U.S. Cl. ..... 347/24; 347/32
(58) Field of Search ..... 347/24, 29, 33, 347/32, 49, 36, 28, 22, 30, 43, 44, 47

(56) References Cited

U.S. PATENT DOCUMENTS 5,801,725 A 9/1998 Neese et al. ..... 347/32
6,203,135 B1 * 3/2001 Murcia et al. ..... 347/22

OTHER PUBLICATIONS

JP 07 171975 A (Mita Ind Co Ltd), Jul. 11, 1995, Hori Setsuo.

* cited by examiner

*Primary Examiner*—Shih-wen Hsieh

(57) ABSTRACT

Methods and arrangements are provided to service multiple staggered printheads in a color inkjet-imaging device. Multiple cleaning units are attached to a service station. Each cleaning unit includes multiple components to service a particular one printhead. Each cleaning unit is offset from an adjacent cleaning unit to form a staggered configuration to service the staggered printheads. The staggered printheads are moved from/to the service station to/from a print zone. The staggered cleaning unit configuration in combination with component positioning provides substantially unhindered access to move the staggered printheads into and out of the service station. Responsive to moving the staggered printheads into the service station, the cleaning units service the staggered printheads.

13 Claims, 18 Drawing Sheets

SINGLE ACTUATION AXIS PRINTHEAD CLEANER ARCHITECTURE FOR STAGGERED PRINTHEADS

TECHNICAL FIELD

The following subject matter relates to inkjet imaging mechanisms. More particularly, the subject matter pertains to an inkjet printhead cleaner service station system architecture for servicing staggered printheads.

BACKGROUND

Printers are imaging devices that print characters onto a printing medium such as a sheet of paper or a polyester film. Printers of many types are available that are controlled by a computer that supplies the images in the form of text or figures that are to be printed. Some printers use a colorant-containing liquid, which may be a dye or ink, to form the images on the printing medium. (By contrast, other imaging devices use a dry toner to form the image). Such printers deliver the colorant to the medium using a printhead that creates the proper patterning of colorant permanently recording the image on the print medium.

One type of imaging device is the thermal inkjet printer, which forms small droplets of ink that are subsequently ejected toward the printing medium in a pattern of dots or pixels that form the images. An ink jet printer typically has a large number of individual colorant-ejection nozzles in a printhead. A carriage supports a printhead that is oriented in a facing, but spaced-apart, relationship to the printing medium. The carriage and supported printhead traverse over the surface of the medium with the nozzles ejecting droplets of colorant at appropriate times under command of the computer or other controller to produce a swath of ink droplets.

The colorant droplets strike the medium and then dry to form dots that when viewed together form one swath or row of the printed image. The carriage is moved an increment in the direction lateral to traverse (or, alternatively, the printing medium is advanced), and the carriage again traverses the page with the printhead operating to deposit another swath. In this manner, the printhead progressively deposits the entire pattern of dots that form the image is by during a number of traverses of the page. To achieve the maximum output rate, the printing is preferably bi-directional, with the printhead ejecting colorant during traverses from left-to-right and right-to-left.

Color inkjet printers utilize several, typically four, different printheads mounted in the print carriage to produce both primary and secondary colors. Each of the printheads produces a different color, with four often-used colors being cyan, yellow, black, and magenta. These primary colors are produced by depositing a droplet of the required color onto a dot location. Depositing multiple droplets forms secondary or shaded colors of different color inks onto the same pixel location, with the overprinting of two or more primary colors producing secondary colors according to well-established optical principles.

Good print quality is one of the most important considerations and basis of competition in the inkjet printer industry. Since images are formed of thousands of individual dots, the quality of the image is ultimately dependent upon the quality of each dot and the arrangement of the dots on the print medium. Because of the fashion in which printing occurs, the quality of the dots can have a surprisingly large effect upon the final image quality.

To illustrate this, consider that when ink blobs or particulate plug inkjet printhead nozzles, color image quality can be negatively affected, or otherwise contaminated with internal bubbles that prevent the nozzles from operating properly. To maintain image quality in view of such ink nozzle plugging, inkjet printers typically include a service station with one or more printhead cleaners to protect and clean printhead ink nozzles.

During operation, clogs in a printhead are periodically cleared by firing a number of drops of ink through each of the nozzles in a process known as "spitting," with the waste ink being collected in a spittoon reservoir portion of the printhead cleaner. For storage, or during non-printing periods, the cleaner includes a capping system to hermetically seal printhead nozzles from contaminants and drying. Occasionally during printing, an elastomeric wiper wipes the printhead surface to remove ink residue, as well as any paper dust or other debris that has collected on the face of the printhead.

In yet another example, color image quality can be negatively affected during the bi-directional printing of secondary colors, wherein overprinting of two primary colors produces each dot. In particular there can be perceived color shift due to the different appearance of a droplet of a first color deposited over a droplet of the second color, as compared with a droplet of the second color deposited over a droplet of the first color. In other words, printed color depends on the order in which various color inks are placed on print media by an imaging device.

To illustrate such undesired color shifting, consider FIGS. 1 and 2, which show a number of printheads 114 laying down color in respective directions onto print media 110. Referring to FIG. 1, consider that an imaging device (not shown) uses four printheads to image color. Each printhead is configured to image one of cyan (C), yellow (Y), magenta (M), and black (K) inks. Specifically, printhead 114-1 images C, printhead 114-2 images Y, printhead 114-3 images M, and printhead 114-4 images K.

These printheads 114 are attached to a carriage (not shown) and aligned with respect to one another relative to a print-media-advance axis. The imaging device prints bi-directionally, meaning that the device prints respective color swaths as the printheads are moved from left-to-right and from right-to-left with respect to print media 110. Arrow 112 illustrates the direction of printhead movement. When the printheads are moved from left-to-right, a first sequence CYMK of color ink is imaged upon the print media. In other words, C is overprinted by Y, Y is overprinted by M, and M is overprinted by K.

Referring to FIG. 2, as the imaging device moves the same four printheads 114 from right-to-left a second sequence KMYC of color inks is imaged upon the print media. (Arrow 202 illustrates the direction of printhead movement). In other words, K is overprinted by M, M is overprinted by Y, and Y is overprinted by C. This second sequence KMYC is exactly opposite the first sequence CYMK that was laid down on the print media when the printheads were moving from left-to-right.

Bi-directional hue shift typically results when inks are imaged on print media is different orders from swath-to-swath. Specifically, bi-directional hue shifts are perceived color changes determined both by how the various color layers mix when overprinted on another color and by how the various mixes react with light. Such defects are especially prevalent on imaging devices that print in "1-pass bi-directional" modes, meaning that a printhead prints only a single time in the same area of print medium.

FIG. 3 shows an example of a conventional technique used by imaging device manufacturers to address undesired bi-directional hue shift imaging defects. Specifically, a staggered printhead configuration 300 is used to address such imaging defects. In this configuration, a cyan (C) printhead 302-1, a magenta (M) printhead 302-2, and a yellow (Y) printhead 303-3 are staggered such that no printhead 302 is on the same horizontal plane as any other printhead 302. This particular configuration 300 of the printheads 302 forces all ink drops or colors (C, M, and Y) to be imaged on a print medium (e.g., paper) in the same order, regardless of whether the printheads are imaging from left-to-right or from right to left with respect to print medium. Optionally, this conventional staggered configuration may include a black ink imaging printhead, which is not shown.

Existing color inkjet printers produce images of acceptable quality and are widely used. However, there is a continuing need for improved inkjet printers and imaging procedures to print high-quality images. Unfortunately, conventional inkjet imaging device designs and procedures have some significant limitations when addressing printhead nozzle ink clogging issues when the printheads are in a staggered configuration (e.g., as illustrated in FIG. 3).

SUMMARY

Methods and arrangements are provided to service multiple staggered printheads in a color inkjet-imaging device. Multiple cleaning units are attached to a service station. Each cleaning unit includes multiple components to service a particular one printhead. Each cleaning unit is offset from an adjacent cleaning unit to form a staggered configuration to service the staggered printheads. The staggered printheads are moved from/to the service station to/from a print zone. The staggered cleaning unit configuration in combination with component positioning provides substantially unhindered access to move the staggered printheads into and out of the service station. Responsive to moving the staggered printheads into the service station, the cleaning units service the staggered printheads

DETAILED DESCRIPTION

Overview

The following described arrangements and techniques provide for a service station in a color inkjet-imaging device to service staggered printheads. This is a significant benefit as compared to traditional techniques, which are not typically capable of servicing staggered printheads. To service staggered printheads, a printhead cleaning unit is described that has a number of re-positioned components as compared to traditional cleaning units. These repositions, in combination with coordinated service station and imaging device carriage movement, allow for unhindered movement of the printheads into and out of the servicing station.

Conventional Service Station Printhead Cleaners

Figure 4:
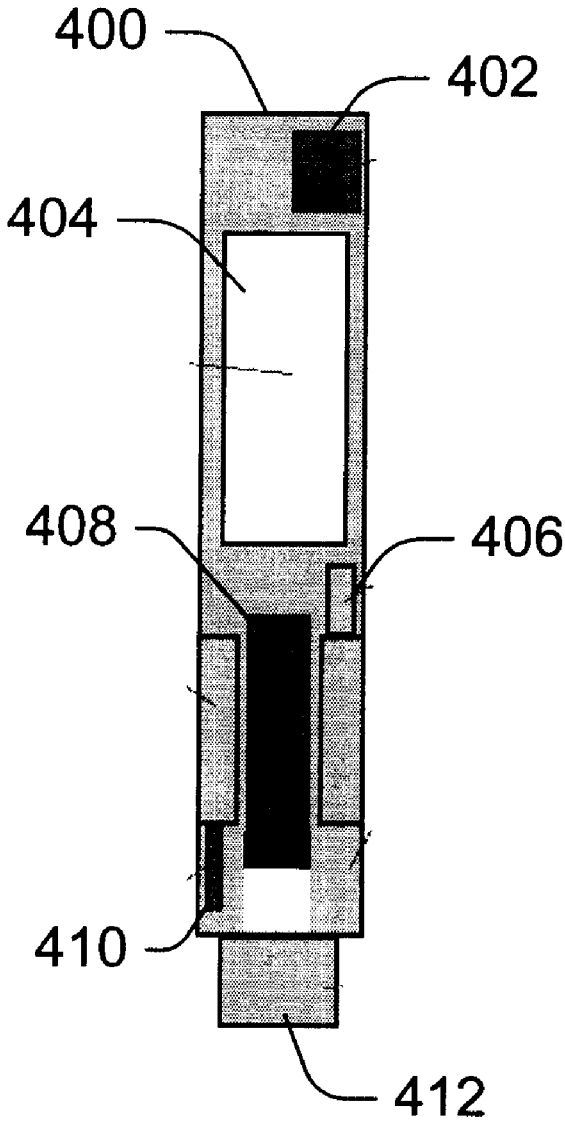
FIG. 4 is a top perspective view of an existing printhead cleaner.

FIG. 4 shows a top-view perspective of a conventional printhead cleaner 400. The cleaner includes a wiper 402, a spittoon reservoir 404, an ink solvent nib 406, capping system 408, a wiper snout 410, and a handle 412. The wiper 402 wipes the printhead surface to remove ink residue, as well as any paper dust or other debris that has collected on the face of the printhead. During operation, potential clogs in the printhead are periodically cleared by firing a number of drops of ink through each of the nozzles in a process known as "spitting," with the waste ink being collected in the spittoon reservoir 404 of the printhead cleaner.

The ink solvent nib 406 is used to deliver an inkjet ink solvent to a printhead that is being serviced. The solvent is a hygroscopic material that absorbs water out of the air (water is a good solvent for ink). Suitable hygroscopic solvent materials include polyethylene glycol ("PEG"), lipponic-ethylene glycol ("LEG"), diethylene glycol ("DEG"), glycerin or other materials known to those skilled in the art as having similar properties. These hygroscopic materials are liquid or gelatinous compounds that will not readily dry out during extended periods of time because they have an almost zero vapor pressure. For the purposes of illustration, the nib is soaked with the preferred ink solvent, PEG.

For storage, or during non-printing periods, the cleaner 400 includes a capping system 408 to hermetically seal printhead nozzles from contaminants and drying. The cleaner assembly also includes a snout wiper 410 for cleaning a rearward facing vertical wall portion of a printhead, which leads up to an electrical interconnect portion of the printhead. Each cleaning unit includes an installation and removal handle 412, which may be gripped by an operator when installing the cleaner unit in their respective chambers or stalls.

Figure 1:
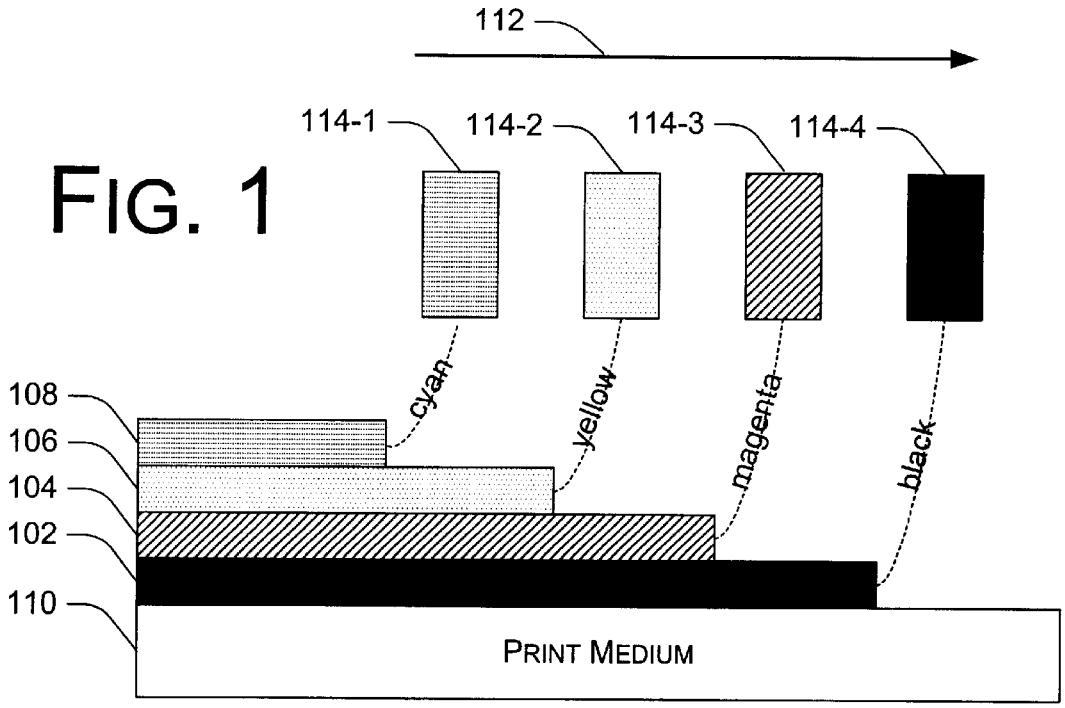
FIG. 1 shows four printheads respectively laying down black, magenta, yellow, and cyan inks on print media as the printheads are moved from left-to-right with respect to a print medium.
Figure 2:
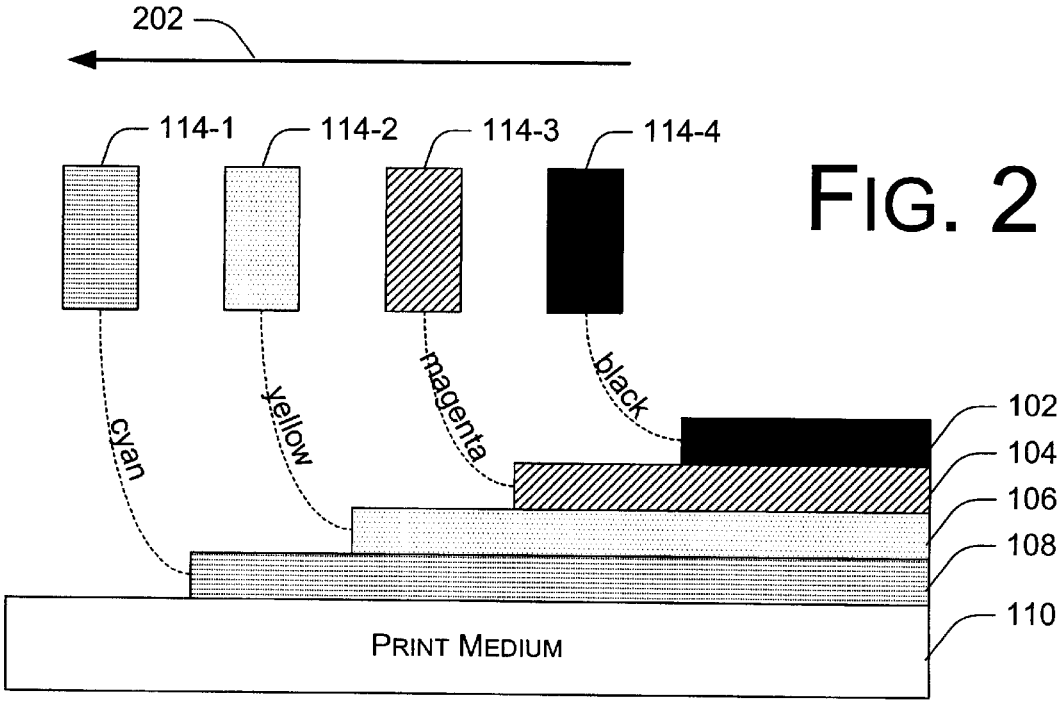
FIG. 2 shows four printheads respectively laying down cyan, yellow, magenta, and black inks on print media as the printheads are moved from right-to-left across a print medium.
Figure 5:
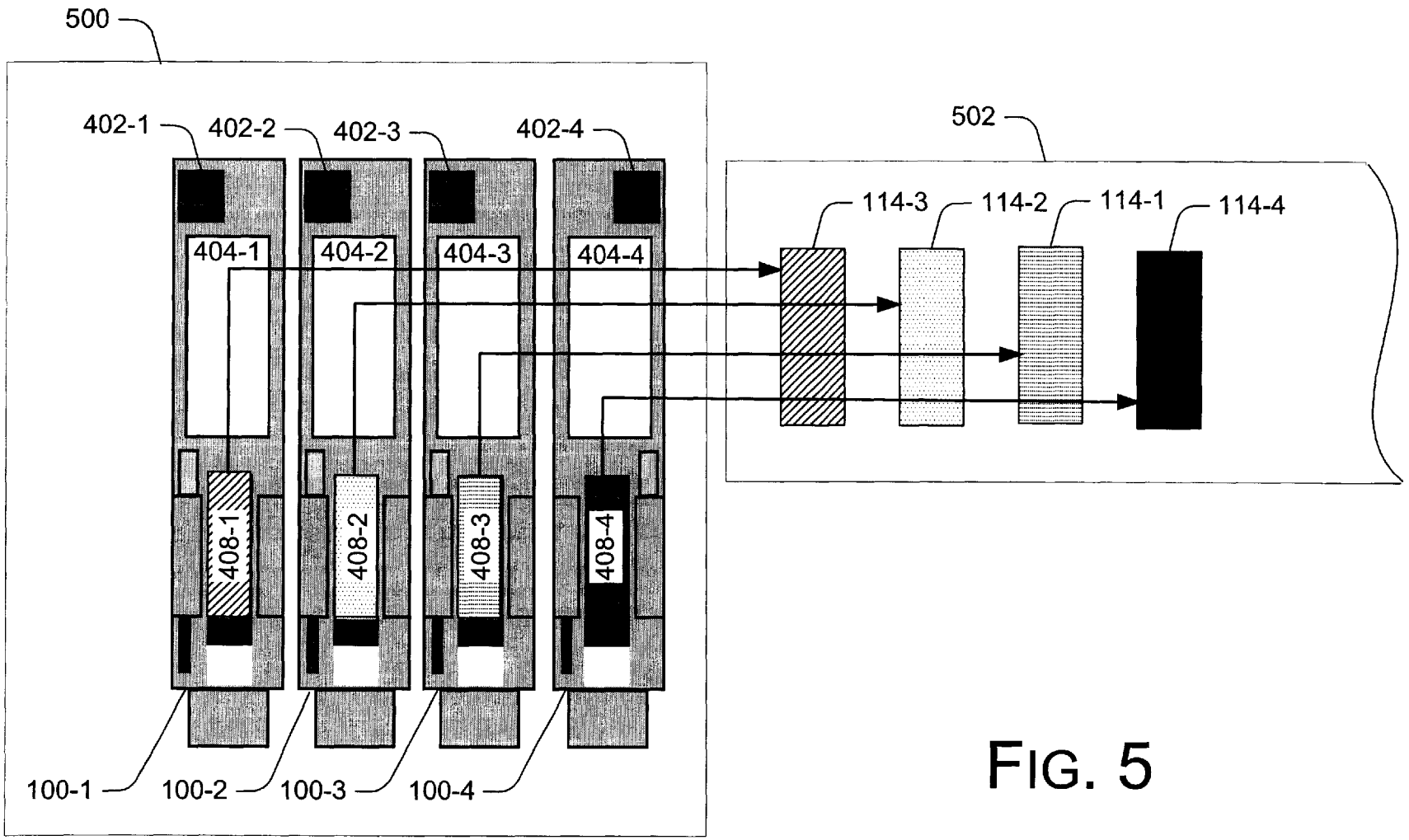
FIG. 5 shows a top perspective of a conventional service station housing four (4) printhead-cleaning units for servicing four respective printheads in a linear configuration.

FIG. 5 shows a top perspective of a conventional service station 500 housing four (4) printhead-cleaning units 400 of FIG. 4 for servicing four respective printheads 114 of FIG. 1. The service station is typically located on top of a moving palette (not shown) that actuates in a linear motion. The printheads are attached to a carriage that moves horizontally with respect to the print media (not shown) that is being imaged upon. The cleaning units are latched to the service station in a linear or in line configuration such that they can service the printheads, which are also aligned in a linear configuration.

The arrows illustrate motion of the printheads 114 with respect to the cleaning units 400, as they are uncapped from capping region 408, moved to the spittoon 404 for spitting, and moved to the print zone 502 for imaging. Although the motion is shown from the perspective of moving printheads, both printheads and printhead cleaning units typically move in the imaging device.

Figure 6:
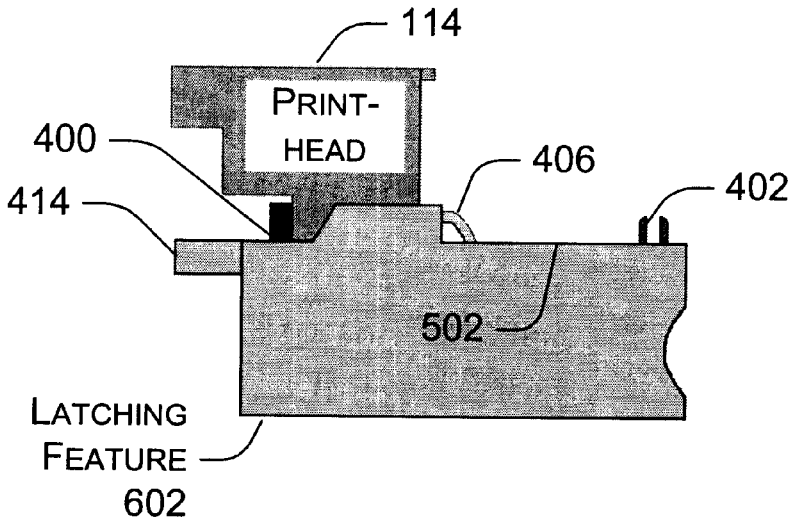
FIG. 6 is a side perspective of a latching mechanism in an inkjet-imaging device for housing a conventional printhead cleaning, wherein the printhead is located in the capping zone of the cleaning unit.
Figure 7:
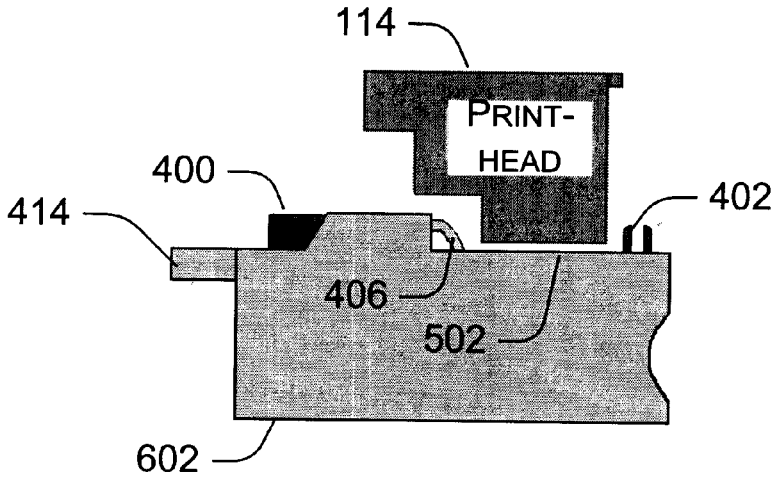
FIG. 7 is a side perspective of a latching mechanism in an inkjet-imaging device for housing a conventional printhead cleaning unit, wherein the printhead is located in the print zone.

To further illustrate the relative motion of the printheads 114 with respect to the cleaning units 400, as they are uncapped from the capping regions 408, moved to spittoons 404 for spitting, and moved to the print zone 502 for imaging, consider FIGS. 6 and 7.

FIG. 6 is a side perspective of a latching mechanism 602 in an inkjet-imaging device for housing a printhead cleaning unit 400 of FIG. 5, wherein the printhead 114 is located in the capping zone 404 of the cleaning unit (see, the capping zone 404 of FIGS. 4 and 5). The printhead can be any one of a cyan, magenta, yellow or black printhead. In this example, with respect to the cleaning unit, the nozzle wiping mechanism 402 and the ink solvent dispensing nib mechanism 406 of the cleaning unit both project above the plane of the cleaning unit. Such a latching mechanism as well as other examples and procedures of conventional inkjet printhead service stations and printhead cleaner units are described in greater detail in U.S. Pat. No. 6,135,585, which is assigned to the assignee hereof, and which is hereby incorporated by reference.

FIG. 7 is a side perspective of a latching mechanism 602 in an inkjet-imaging device for housing a printhead cleaning unit 400 of FIGS. 4 and 5, wherein the printhead 114 is located in the print zone 502 (see, the print zone 502 of FIG. 5). The print zone is the zone wherein print media is imaged upon by the printhead. Thus, FIGS. 6 and 7 further illustrate the relative motion of the printheads of FIG. 5 with respect to the cleaning units, as they are uncapped from the capping region 408, moved to the spittoon 404 for spitting, and then moved to the print zone for imaging.

Figure 3:
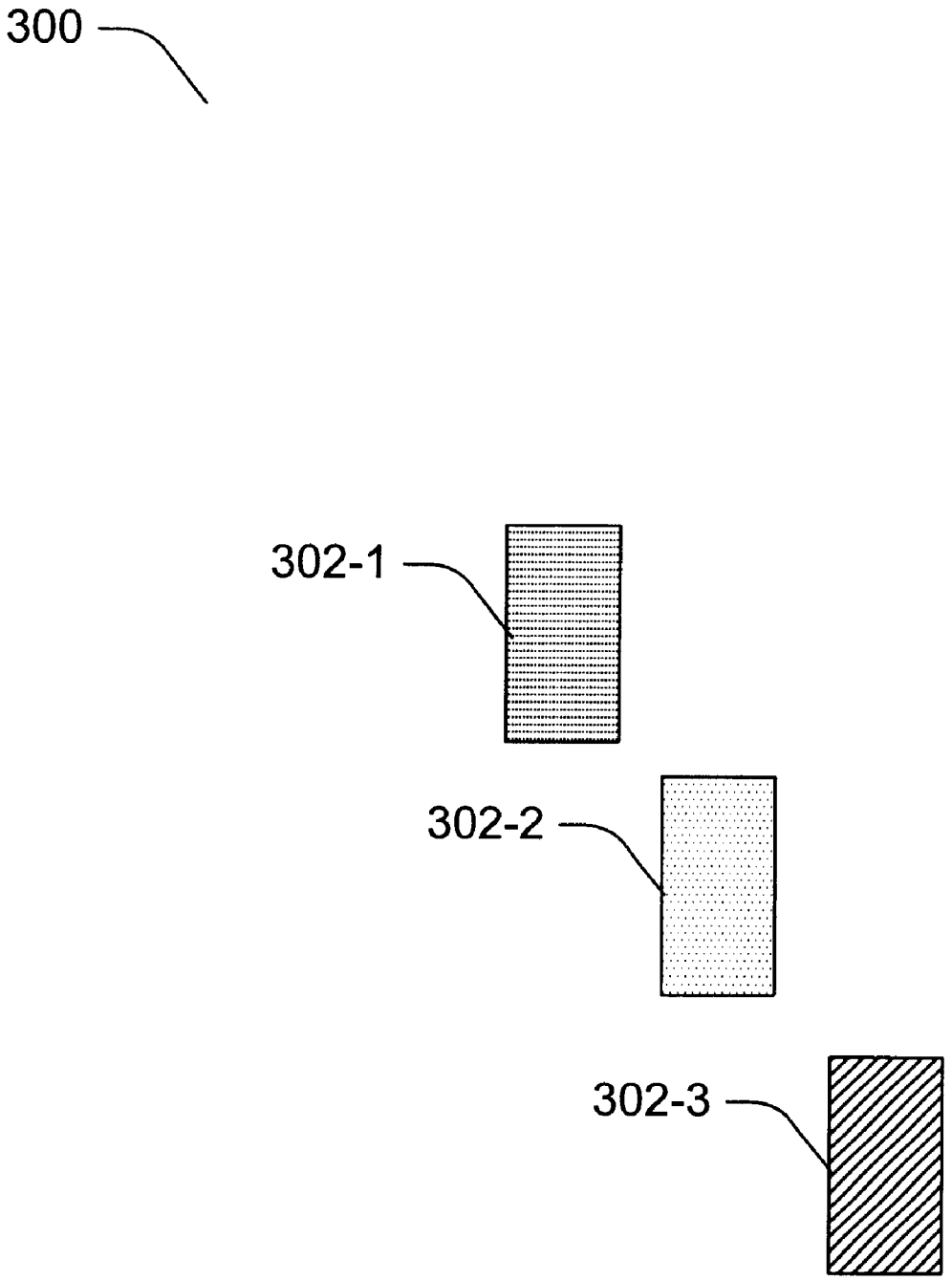
FIG. 3 shows a conventional staggered printhead configuration typically used to address hue shift imaging defects in bi-directional color imaging devices.

Unfortunately, conventional inkjet imaging device printhead service station designs (e.g., the station 502 design of FIG. 5) do not provide for cleaning units that can service printheads that are in a staggered configuration (e.g., the staggered printhead configuration 300 of FIG. 3). This is because conventional printhead cleaning unit designs (e.g., cleaning units 400 of FIGS. 4 and 5) do not allow for uninhibited movement of printheads from the capped position to the print zone position (see the capped position 408 and the print zone 502 of FIG. 5). Various aspects of this problem are now discussed.

Figure 8:
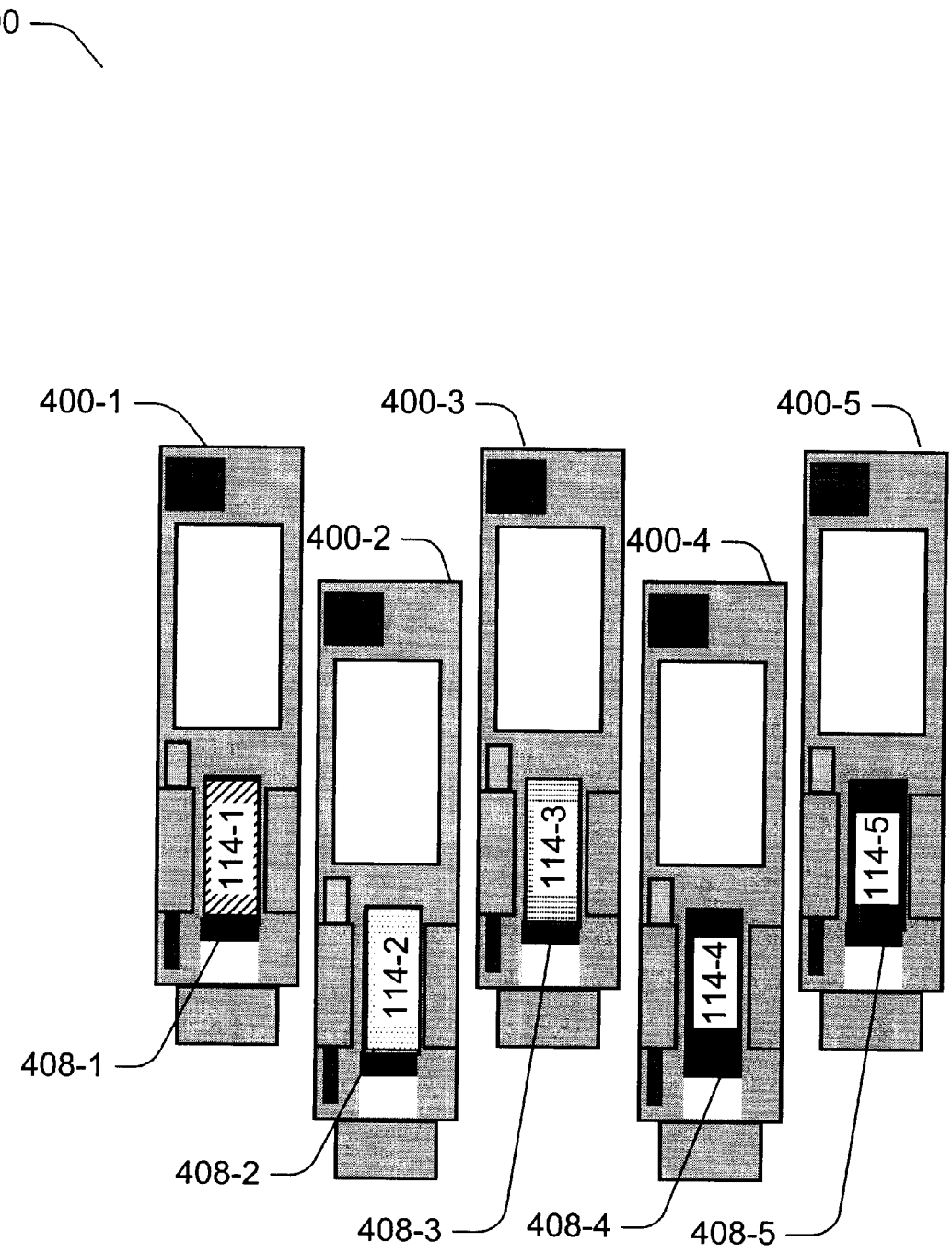
FIG. 8 shows that a service station with five (5) conventional printhead cleaning units that are in a staggered configuration with respect to one another is inoperable.

FIG. 8 shows a service station 800 with five printhead cleaning units 400 that are in a staggered configuration with respect to one another. Each cleaning unit is capping a respective printhead 114 at a respective capping station 408.

Figure 9:
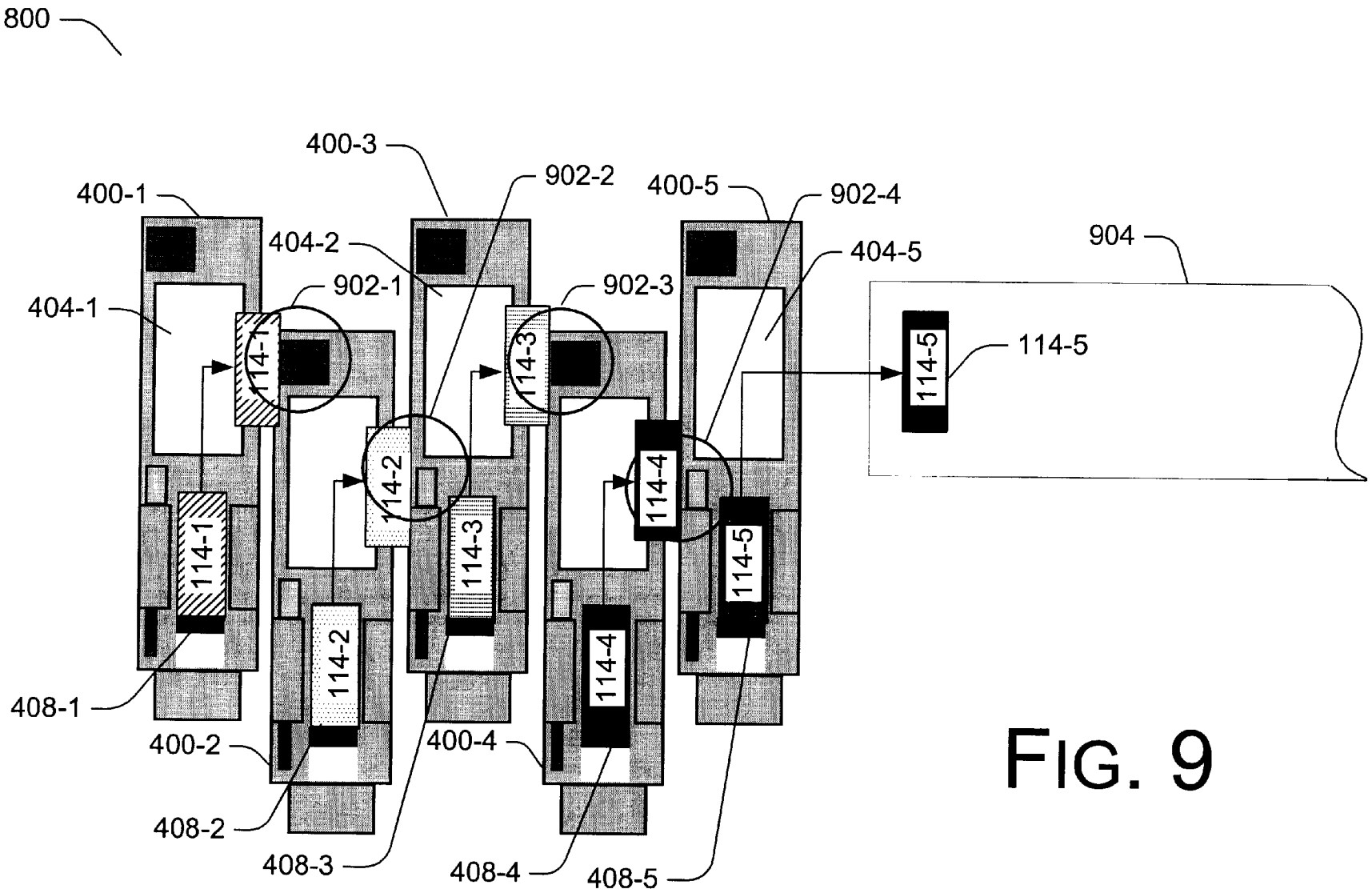
FIG. 9 shows that when an attempt is made to move staggered printheads from conventional capping stations to respective spittoon reservoirs, and into to a print zone, four of the five printheads collide with portions of a conventional adjacent cleaning unit.

FIG. 9 shows that when an attempt is made to move the five printheads 114 from respective capping stations 408, to respective spittoon reservoirs 404, and into to the print zone 904, four of the five printheads (e.g., printheads 114-1 through 114-4) collide with portions 902 of an adjacent cleaning unit 400. Specifically, as the magenta ink dispensing printhead 114-1 is moved from the spittoon 404-1 towards the print zone, the magenta printhead collides with the nozzle-wiping unit (see, the wiping unit 402 of FIG. 4) of cleaning unit 400-2. The circled region 902-1 illustrates this first collision.

As the yellow ink dispensing printhead 114-2 is moved from the spittoon 404-2 towards the print zone 904, the yellow printhead collides with the solvent dispensing nib (e.g., see also nib 406 of FIG. 4) of the cleaning unit 400-2. The circled region 902-2 illustrates this second collision. Additionally, as the cyan ink dispensing printhead 114-3 is moved from its respective spittoon towards the print zone 904, the printhead collides with the wiper unit of the adjacent cleaning unit 400-3. The circled region 902-3 illustrates this third collision. As the first black ink dispensing printhead 114-4 is moved from its respective spittoon towards the print zone 904, the black printhead collides with the wiper unit of the adjacent cleaning unit 400-4. The circled region 902-4 illustrates this fourth collision.

In this example, the only printhead 114 that does not collide with a portion of an adjacent printing unit 400 is the second black ink dispensing printhead 114-5. This is because there is no staggered cleaning unit situated adjacent to the path of the printhead in the direction of the printing zone 904. However, since the carriage physically joins the five printheads into a single physical component, and because adjacent printhead cleaner components block four of the five printheads from the print zone, not even a single printhead can make it into the print zone. Thus, the imaging device is unable to form a proper image on any print media.

Figure 10:
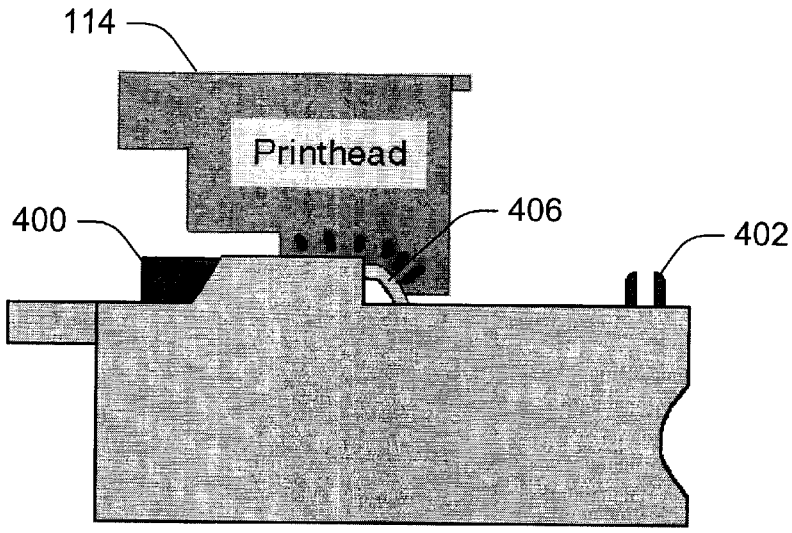
FIG. 10 shows a collision of a printhead with a nib attached to a conventional cleaning unit positioned adjacent to the printing unit used to service the printhead.
Figure 11:
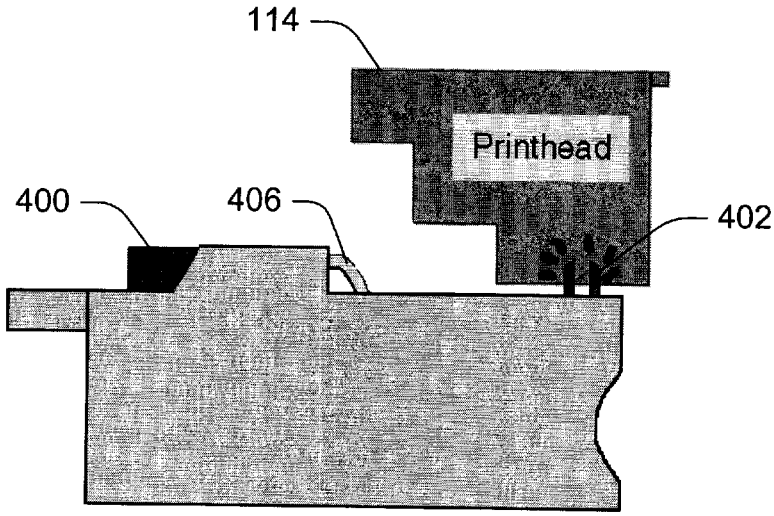
FIG. 11 shows a collision of a printhead with a nozzle-wiping unit attached to a conventional cleaning unit positioned adjacent to the printing unit used to service the printhead.

FIGS. 10 and 11 further illustrate aspects of collisions that a conventional printhead 114 in a staggered configuration with respect to other printheads experiences while moving in the direction of a printing zone. Specifically, FIG. 10 shows a collision of a printhead 114 with a nib 406 attached to a cleaning unit 400 positioned adjacent to the printing unit used to service the printhead. FIG. 11 shows a collision of a printhead 114 with a nozzle-wiping unit 402 attached to a cleaning unit 400 positioned adjacent to the printing unit used to service the printhead.

Figure 12:
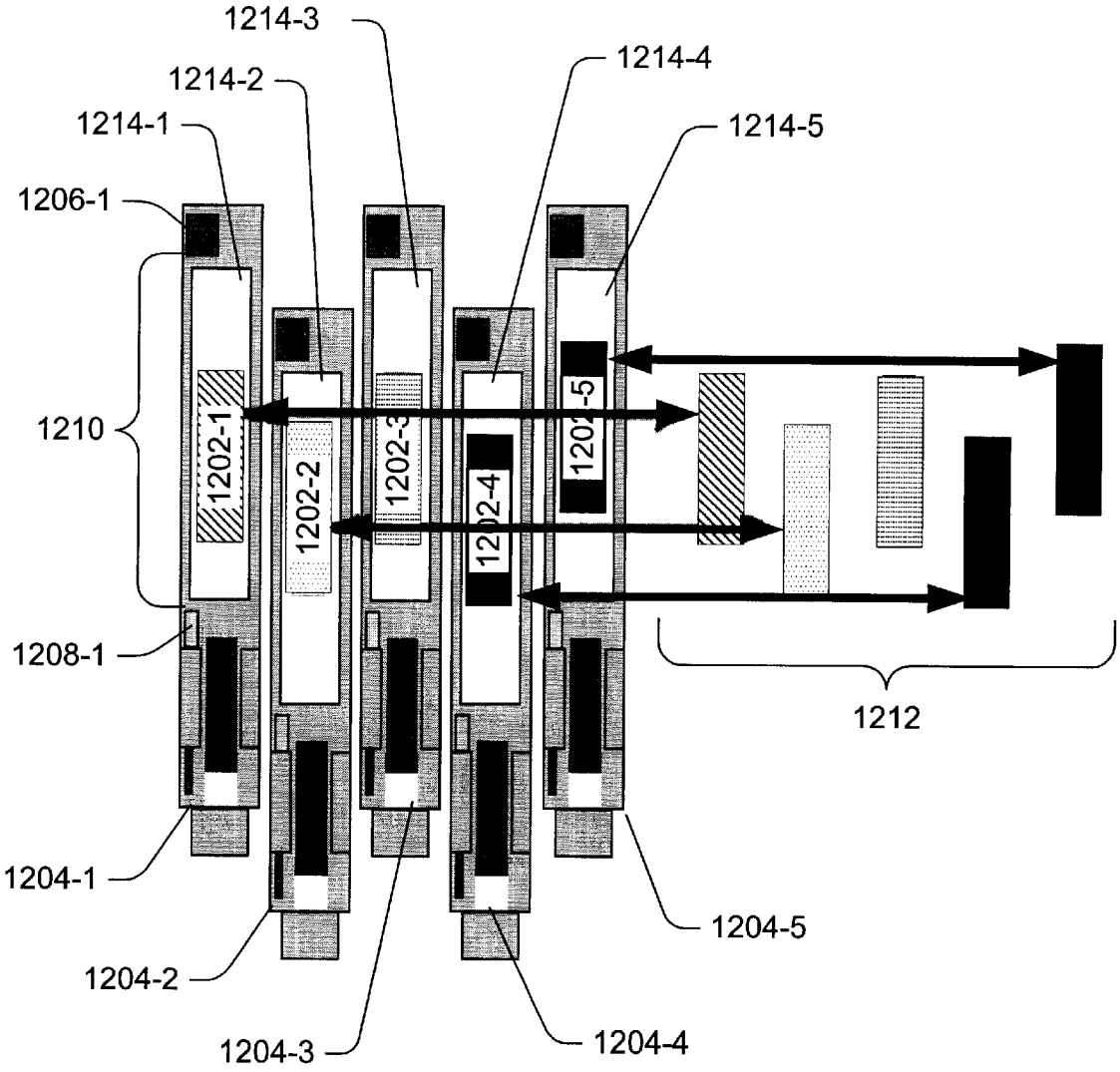
FIG. 12 shows one solution to the printer head and adjacent cleaning unit collision problem encountered in a staggered printhead configuration.

FIG. 12 shows one solution to the printer head 1202 and adjacent cleaning unit 1204 collision problem encountered in a staggered printhead configuration. In particular, a distance 1210 separates the wiper 1206 and nib 1208 such that there is enough room for the printheads to move to the print zone 1212 without colliding with portions of adjacent cleaning units.

For example, as illustrated by the arrow representing the movement between the magenta ink printhead 1202-1 in the spittoon 1214-1 and the corresponding printhead in the print zone 1212, there is enough room for the printhead to move from the spittoon to the print zone without colliding with the wiper 1206 of adjacent cleaning unit 1204-2. Additionally, as illustrated by the arrow representing the movement between the yellow ink printhead 1202-2 in the spittoon 1214-2 and the corresponding printhead in the print zone 1212, there is enough room for the printhead to move from the spittoon to the print zone without colliding with the wiper 1206 of adjacent cleaning unit 1204-3, and so on.

Accordingly, this solution provides means for servicing a staggered printhead configuration without causing the printheads to collide with portions of adjacent cleaning units. However, this solution of FIG. 12 also results in a substantially large printhead servicing station footprint and corresponding large printhead cleaner units 1204. It is desirable to fabricate imaging devices with a small footprint, or compact size to enable users to locate their imaging device in a substantially larger variety of locations.

Figure 13:
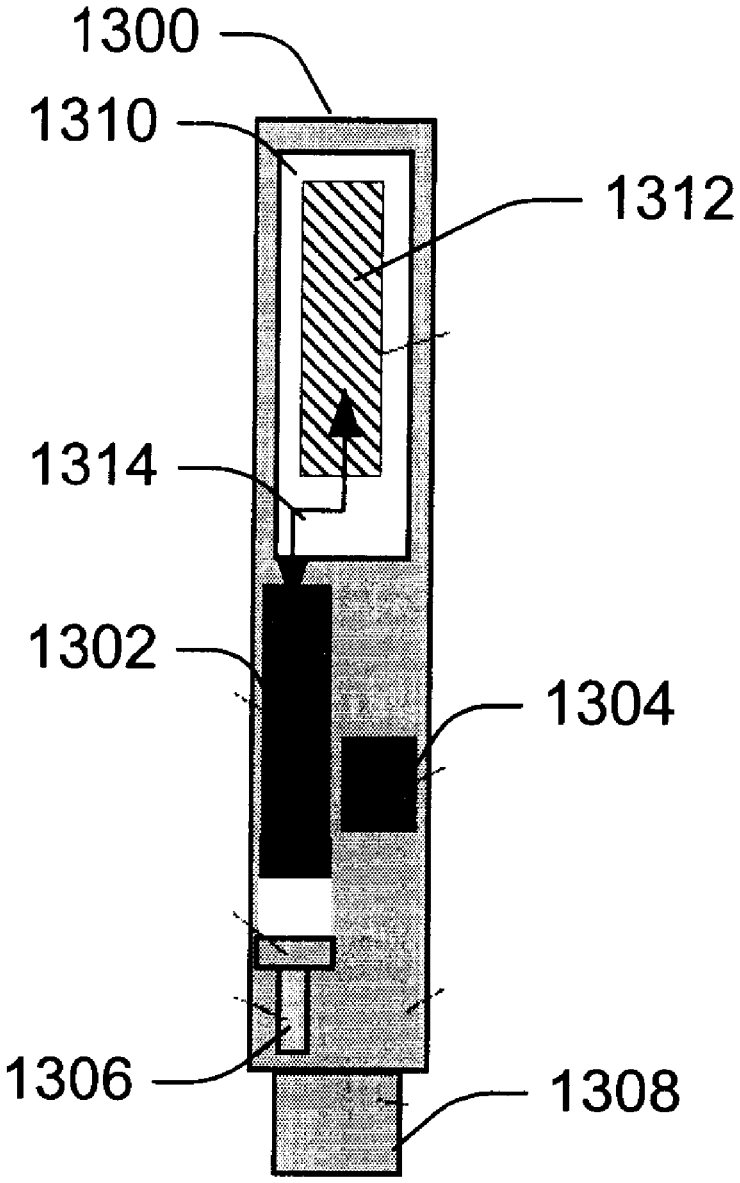
FIG. 13 shows a top view of printhead-cleaning unit configured to service a printhead that is in a staggered printhead configuration.

FIG. 13 shows a top view of printhead-cleaning unit 1300 configured to service a printhead that is in a staggered printhead configuration. More particularly, cleaning components 1302 through 1310 are optimally positioned on the cleaning unit such that when the printhead moves to/from-servicing aspects of the cleaning unit (e.g., to/from the spittoon area 1310), the printhead will not collide with components of an adjacent cleaning unit. Moreover, the printhead cleaning unit 1300 presents a small service station footprint results when servicing staggered printheads as compared to the footprint that results in a similar printhead configuration using cleaning units of FIG. 12.

The capping unit 1302 of the cleaning unit 1300 is located off center with respect to the cleaning unit's body. This allows positioning of the nozzle-wiping unit 1306 adjacent to the capping unit as shown. The ink solvent dispensing nib 1306 is located at the proximal end of the capping unit nearest the handle 1308. The zigzag arrow 1314 shows the relative motion of the printhead to/from the capping unit 1302 relative to the position of the spittoon reservoir 1310.

Figure 14:
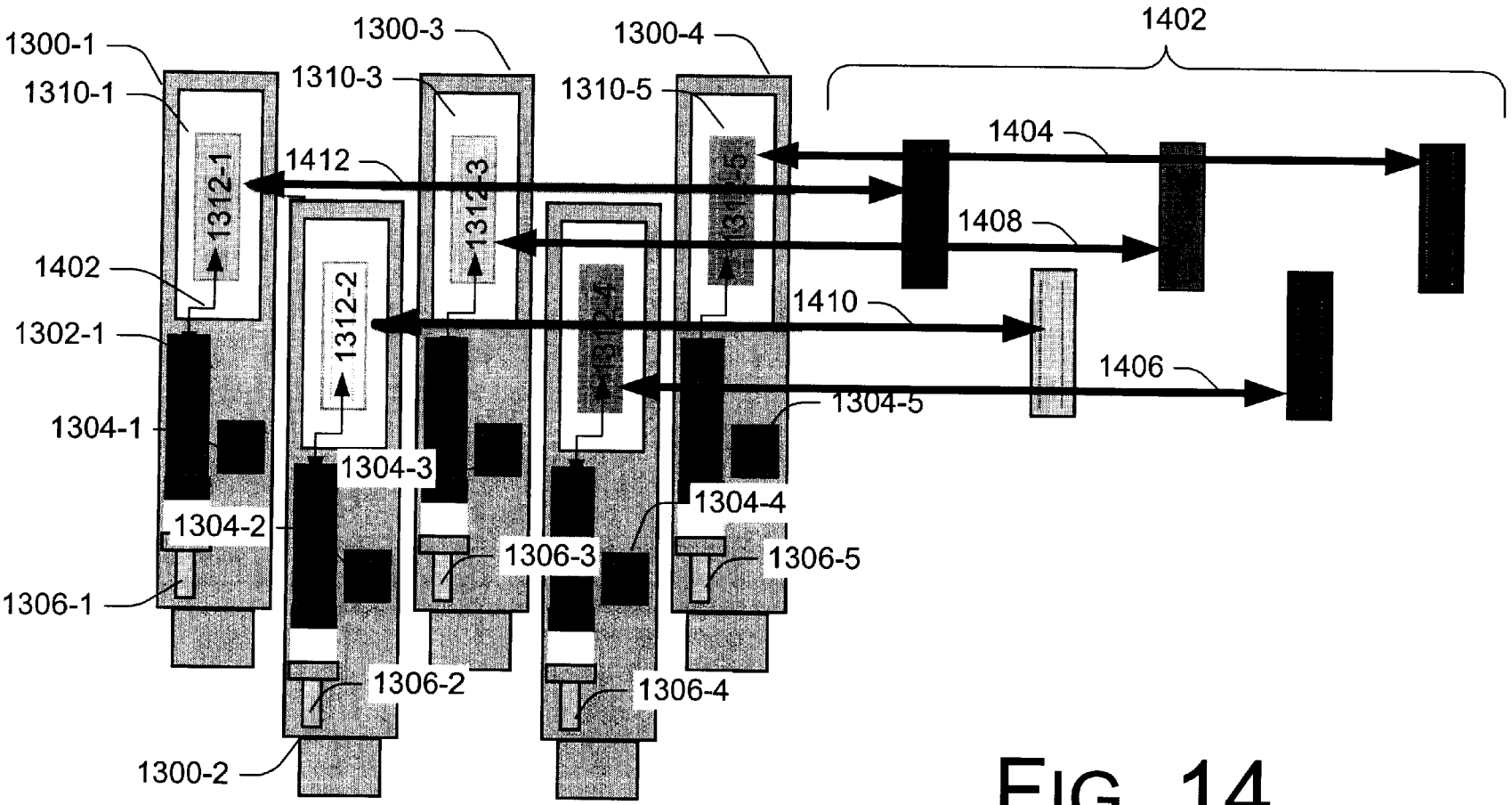
FIG. 14 shows five printhead cleaning units that are configured to service printheads in a staggered configuration. Zigzag arrows represent each printhead's motion from a respective capping unit to a related spittoon.

FIG. 14 shows the configuration of five printhead cleaning units 1300 used to service staggered printheads 1312. Zigzag arrows represent each printhead's motion from a respective capping unit to a related spittoon 1310. For example, zigzag arrow 1402 represents the relative motion of printhead 1312-1 from capping unit 1302-1 to related spittoon 1310-1. As shown by the bold horizontally positioned arrows 1404 through 1412, each staggered printhead has unhindered access to/from the cleaning units to/from the print zone 1402. In other words, a printhead does not collide with any component (e.g., a wiper or nib) of an adjacent cleaning unit.

Although the example of FIG. 14 uses five cleaning units 1300 and five corresponding printheads 1312 to describe a printhead cleaning architecture for staggered printheads, any number of printheads and cleaning units can be used. For example, two cleaning units and two staggered printheads would benefit from the description herein. Additionally, a single cleaning unit and a single printhead that includes CMYK ink nozzles would benefit from the description herein because the imaging device's footprint is relatively smaller.

Figure 15:
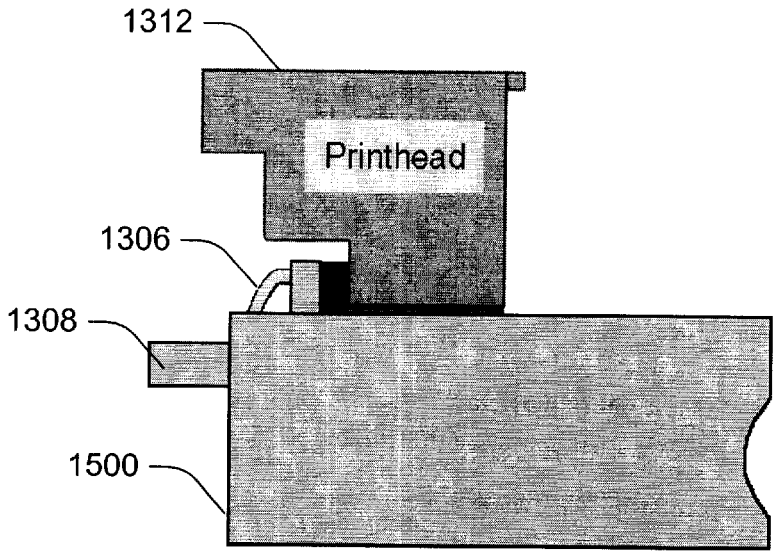
FIG. 15 shows a side view perspective of a printhead service station and a printhead in the capping position.
Figure 16:
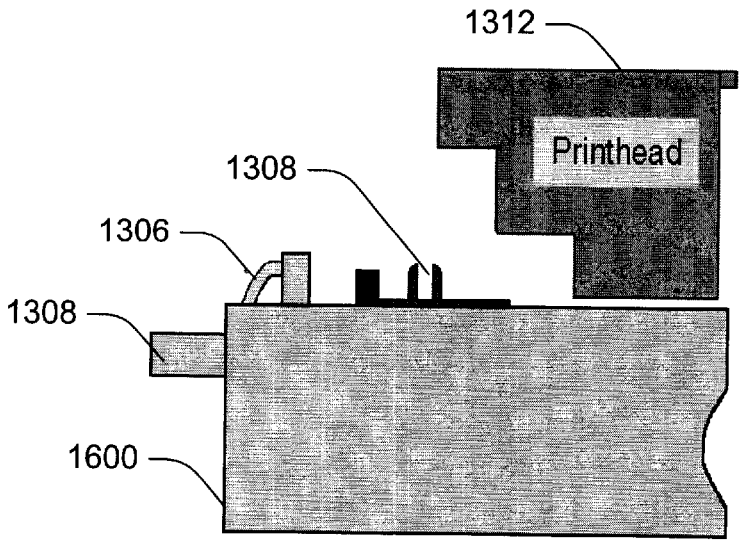
FIG. 16 shows a side view perspective of a printhead service station and a printhead in the spitting position.

FIGS. 15 through 20 show various printhead service functions with respect to the cleaning unit 1300 of FIG. 13. In particular, FIG. 15 shows a side view perspective of a printhead service station 1500 and a printhead 1312 in the capping position (e.g., see the capping unit 1302 of FIGS. 13 and 14). FIG. 16 shows a side view perspective of a printhead service station 1600 and a printhead 1312 in the spitting position (e.g., see the spittoon unit 1310 of FIGS. 13 and 14).

Figure 17:
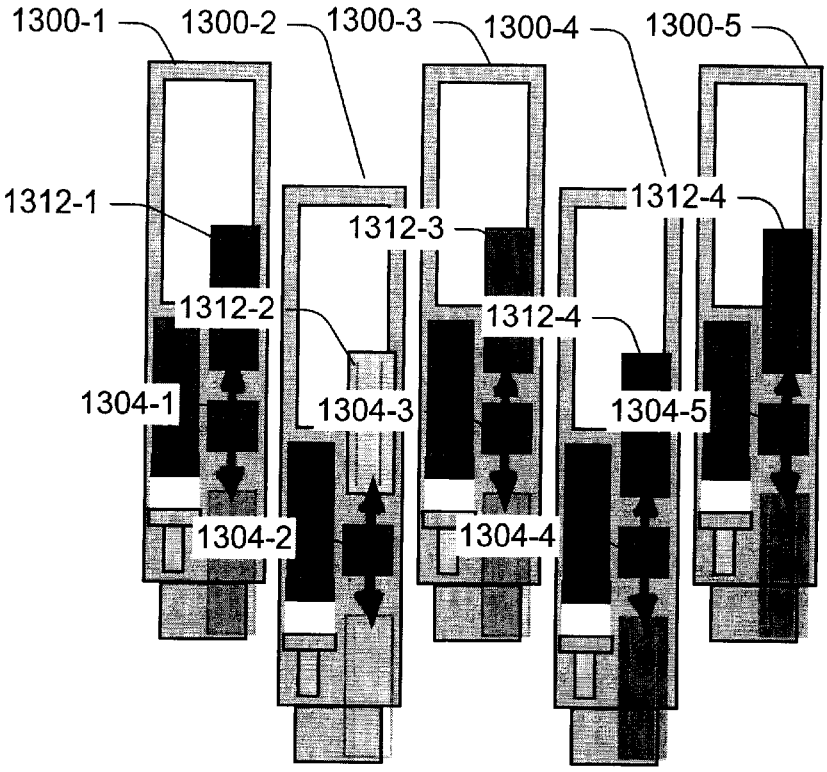
FIG. 17 shows a top view of a number of printhead cleaners being used by a number of staggered printheads to service corresponding ink nozzles by wiping them across respective wiping units. The bolded arrows positioned at the proximal end of each printhead and which trend across respective wiping units show relative motion of the printheads with respect to the wiping units.
Figure 18:
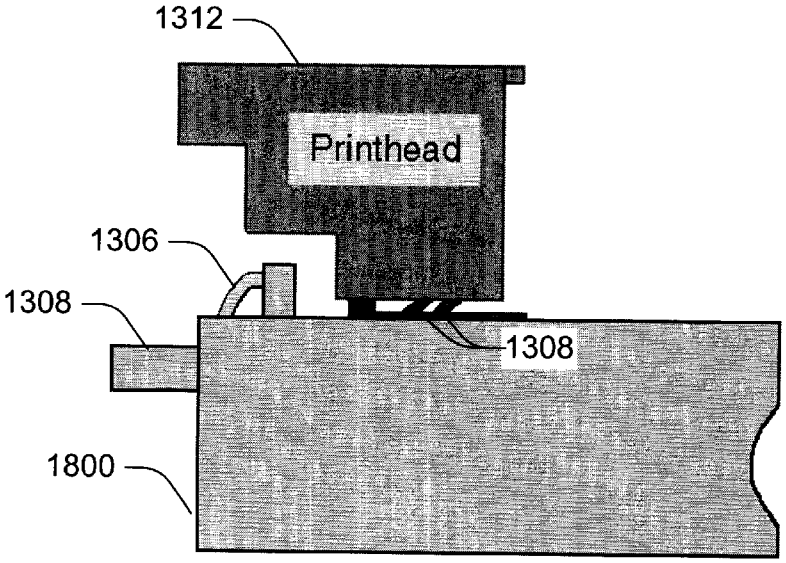
FIG. 18 is a side view of a printhead serviced by a wiping unit.

FIG. 17 shows a top view of a number of printhead cleaners 1300 used by a number of staggered printheads 1312 to service corresponding ink nozzles by wiping them across respective wiping units 1304. The bolded arrows positioned at the proximal end of each printhead and which trend across respective wiping units show relative motion of the printheads with respect to the wiping units. FIG. 18 is a side view of a printhead 1312 serviced by a wiping unit 1308.

Figure 19:
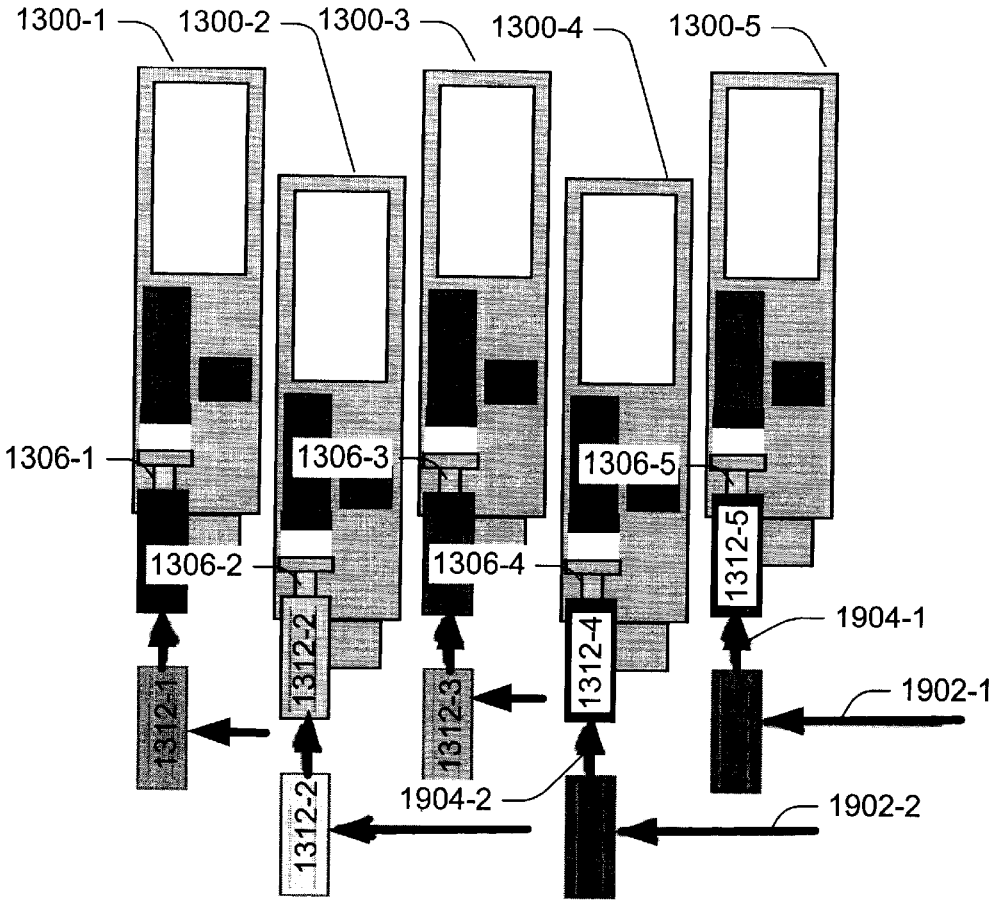
FIG. 19 shows a top view of a number of printhead cleaners used by a number of staggered printheads to gather ink solvent at respective solvent nibs 1306.
Figure 20:
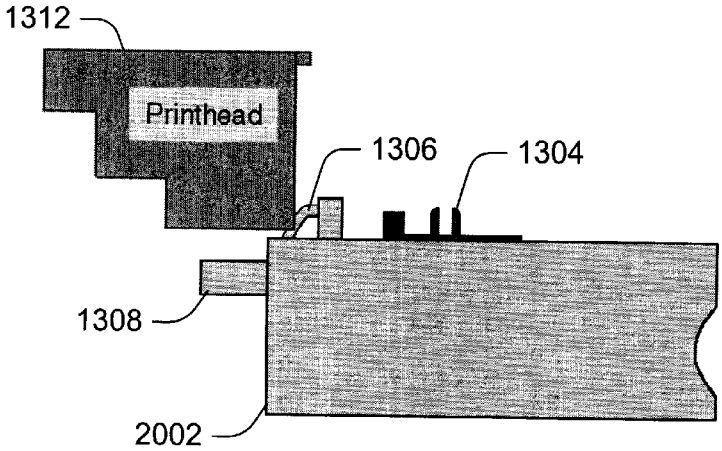
FIG. 20 is a side view of a printhead being serviced by a ink solvent nib.

FIG. 19 shows a top view of a number of printhead cleaners 1300 used by a number of staggered printheads 1312 to gather ink solvent at respective solvent nibs 1306. In this example, the printheads move from the print zone (not shown) as represented by the horizontal arrows (e.g., arrows 1902). After aligning each printhead with its corresponding nib, the printhead moves to the nib as shown by the vertical bolded arrows (e.g., arrows 1904). FIG. 20 is a side view of a printhead 1312 being serviced by a ink solvent nib 1306.

Exemplary Imaging Device For Servicing Staggered Printheads

Figure 21:
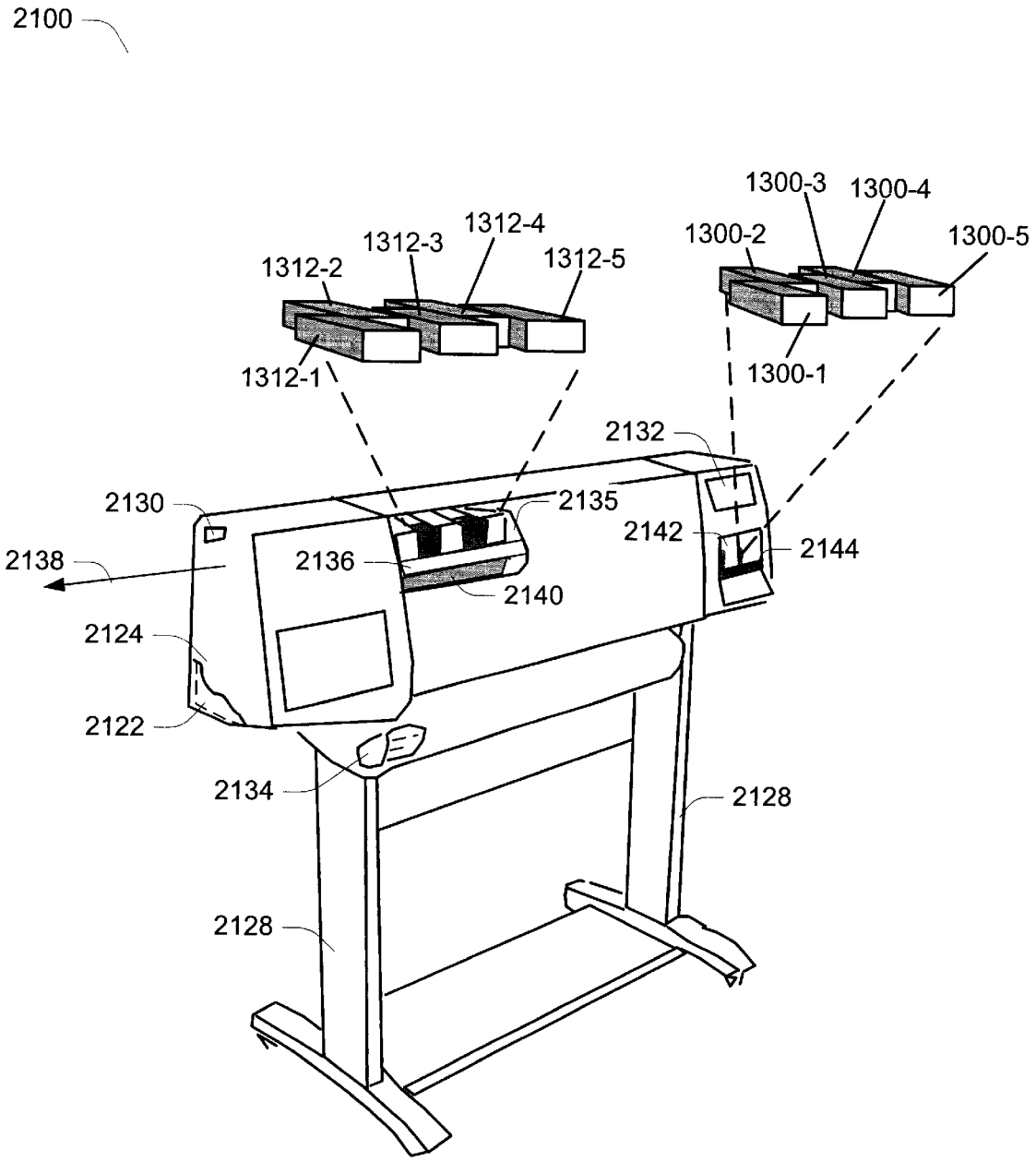
FIG. 21 is a perspective view of one form of an inkjet-imaging device, here an inkjet plotter, including one form of a replaceable inkjet printhead cleaner service station system, shown here to service a set of single actuation axis staggered inkjet printheads.

FIG. 21 is a perspective view of one form of an inkjet-imaging device 2100, here an inkjet plotter, including one form of a replaceable inkjet printhead cleaner service station system, shown here to service a set of single actuation axis staggered inkjet printheads. The imaging device may be used for printing engineering and architectural drawings, as well as high quality poster-sized images, and so on, in an industrial, office, home, or other environment. Although the imaging device is described in this example as an inkjet plotter, the imaging device also includes desk top printers, portable printing units, copiers, cameras, video printers, and facsimile machines, and so on, for producing inkjet images.

Inkjet plotter 2100 includes a chassis 2122 surrounded by housing or casing enclosure 2124 such as a plastic material, together forming a print assembly portion 2126 of the plotter. A desk or tabletop, or leg assemblies 2128 may support the print assembly portion. The plotter has a plotter controller, illustrated schematically as a microprocessor 2130, that receives instructions from a host device, typically a computer, such as a personal computer, a server, a laptop computer, a computer aided drafting (CAD) computer system, and so on. The plotter controller may also operate in response to user inputs provided through a keypad and status display portion 2132, located on the exterior of the casing 2124. A monitor coupled to the computer host may also be used to display visual information to an operator, such as the plotter status or a particular program being run on the host computer.

A conventional print media handling system (not shown) may be used to advance a continuous sheet of print media 2134 from a roll through a print zone 2135. The print media may be any type of suitable material such as paper, poster board, fabric, transparencies, Mylar®, and so on. A carriage guide rod 2136 is mounted to the chassis 2122 to define a scanning axis 2138, with the guide rod 2136 slideably supporting an inkjet carriage 2140 for travel back and forth, reciprocally, across the print zone 2135. A conventional carriage drive motor (not shown) may be used to propel the carriage 2140 in response to a control signal received from the controller 2130.

To provide carriage positional feedback information to controller 2130, a conventional metallic encoder strip (not shown) may be extended along the length of the print zone 2135 and over the servicing region 2142. A conventional optical encoder reader may be mounted on the back surface of printhead carriage 2140 to read positional information provided by the encoder strip. The manner of providing positional feedback information via the encoder strip reader may also be accomplished in a variety of ways known to those skilled in the art.

Upon completion of printing an image, the carriage 2140 may be used to drag a cutting mechanism across the final trailing portion of the media to sever the image from the remainder of the roll 2134. The illustrated inkjet printing mechanism may also be used for printing images on pre-cut sheets, rather than on media supplied in a roll 2134.

In the print zone 2135, the media sheet receives ink from an inkjet printhead 1312 or cartridge, such as one or more black ink cartridges and three monochrome color ink cartridges shown in greater detail in FIGS. 12 and 14. The printheads are in a staggered configuration with respect to one another as shown.

Color printheads 1312 are described as each containing a dye-based ink of the colors yellow, magenta and cyan, respectively, although the color pens may also contain pigment-based inks. Other types of ink may also be used in the pens such as paraffin-based inks, as well as hybrid or composite inks having both dye and pigment characteristics. The illustrated plotter 2120 uses an "single actuation-axis service station", ink delivery system having main stationary reservoirs (not shown) for each ink (black, cyan, magenta, yellow) located in an ink supply region 2158 system. A single actuation axis means that the service station only moves in a single direction (e.g., back and forth), in contrast to dual-axis movement that requires additional up and down motion.

The printheads 1312 are replenished by ink conveyed through a conventional flexible tubing system (not shown) from stationary main reservoirs, so only a small ink supply is propelled by carriage 2140 across the print zone 2135, which is located "off-axis" from the path of printhead travel. As used herein, the term "printhead", "pen" or "cartridge" may also refer to replaceable printhead cartridges where each pen has a reservoir that carries the entire ink supply as the printhead reciprocates over the print zone.

The printheads 1312 each have an orifice plate (not shown) with a plurality of nozzles formed there through in a manner well known to those skilled in the art. The printheads are thermal inkjet printheads, although other types of printheads may be used, such as piezoelectric printheads. The thermal printheads typically include a plurality of resistors, which are associated with the nozzles. Upon energizing a selected resistor, a bubble of gas is formed which ejects a droplet of ink from the nozzle and onto a sheet of paper in the print zone 2135 under the nozzle. The printhead resistors are selectively energized in response to firing command control signals delivered from the controller 2130 to the printhead carriage 2140.

The printheads are serviced or cleaned by a service station 2144 that includes a number of printhead cleaning units 1300. Recall that conventional printhead-cleaning units (e.g., the printheads 400 of FIGS. 4 and 5) do not allow for servicing of printheads in a staggered configuration without undesired collisions between the printheads and portions of adjacent cleaning units. In contrast to these conventional printhead cleaning units, the printheads 1312 provide for servicing of staggered printheads is a manner that is free of undesired collisions and in a manner that provides a substantially small servicing station footprint.

Figure 22:
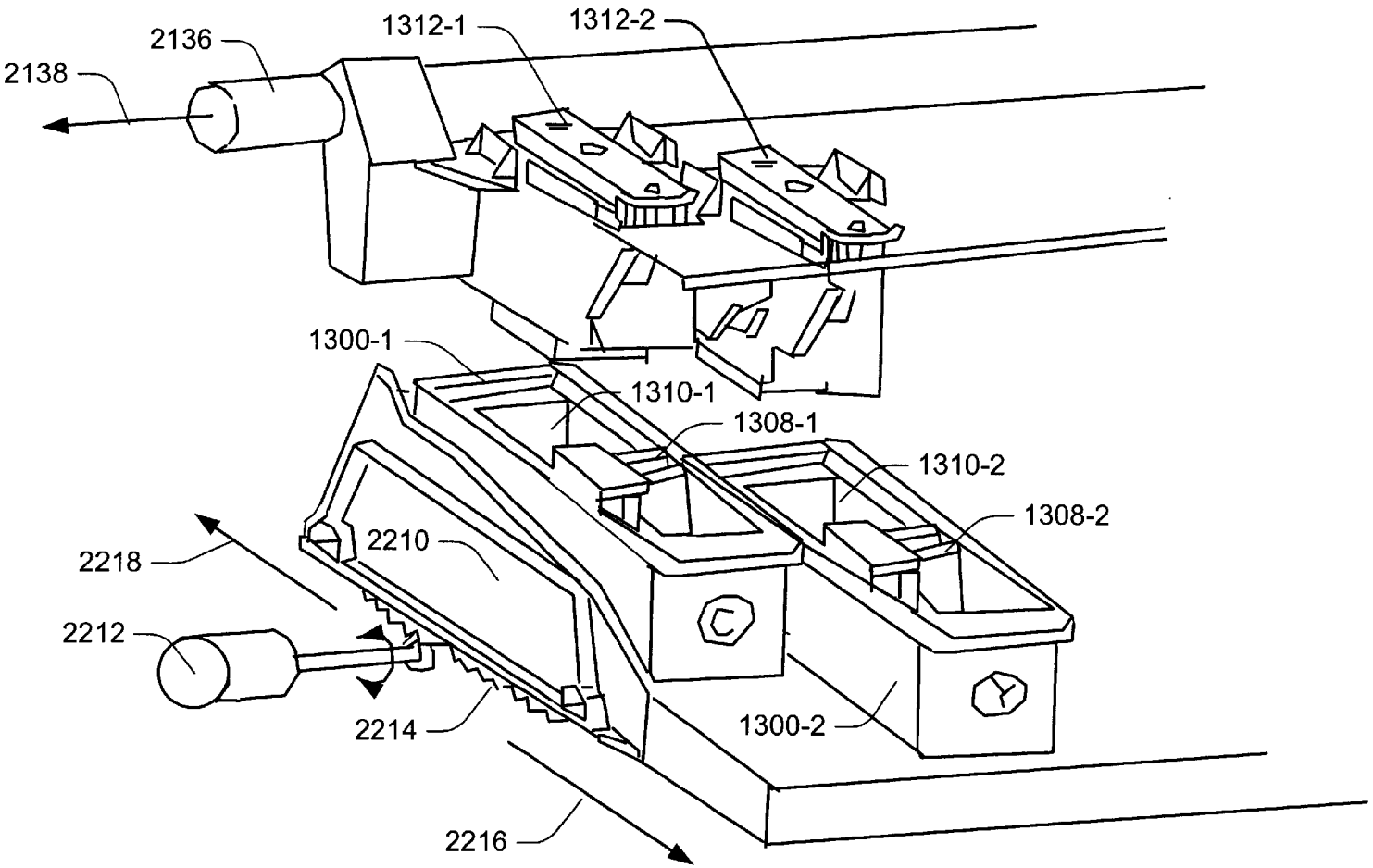
FIG. 22 is an enlarged perspective view of the replaceable service station prior to servicing the printheads.

FIG. 22 is an enlarged perspective view of the replaceable service station 2144 prior to servicing the printheads 1312. The service station includes a translationally moveable pallet 2210, which is selectively driven by a motor 2212 through a rack and pinion gear 2214 assembly in a forward direction 2216 and in a rearward direction 2218 in response to a drive signal received from the controller 2130.

The service station 2144 includes five replaceable inkjet printhead cleaner units 1300-1 through 1300-5 in a staggered configuration (only units 1300-1 and 1300-2 are shown) for servicing the respective printheads 1312-1 through 1312-5. Note that printhead 1312-2 is in a more forward position, or offset as compared to printhead 1312-1. This offset of the printheads is referred to as a "stagger" configuration. Each of the cleaner units includes an installation and removal handle (e.g., the handle 1308 of FIG. 13), which may be gripped by an operator when installing the cleaner units in their respective staggered chambers or stalls as defined by the service station pallet 2210. Following removal, the cleaning units are typically disposed of and replaced with a fresh unit, so the units may also be referred to as "disposable cleaning units".

An Exemplary Printhead Servicing Module

Figure 23:
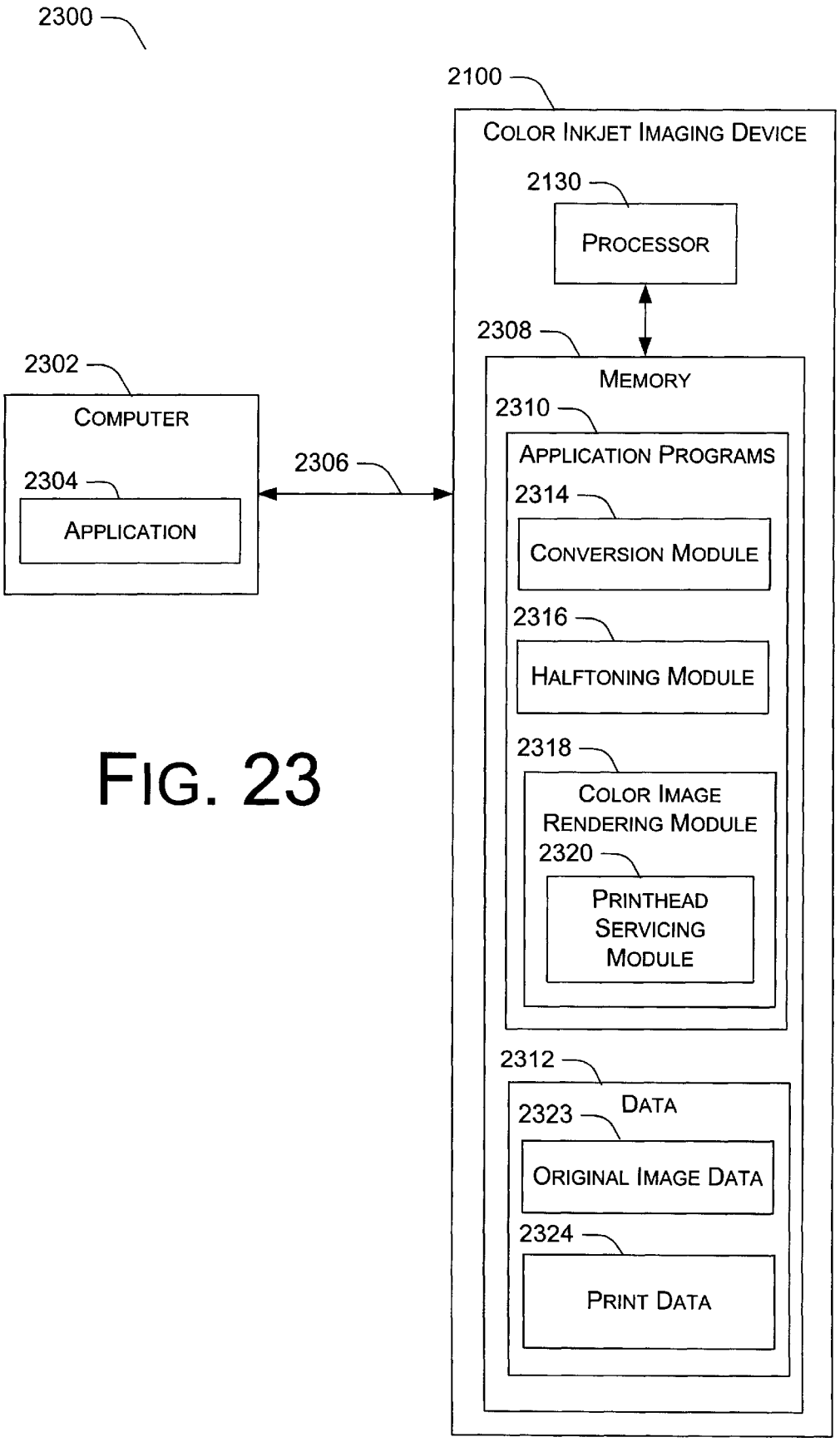
FIG. 23 is a block diagram that shows an exemplary system to service staggered printheads.

FIG. 23 is a block diagram that shows an exemplary system 2300 to service staggered printheads. The system is operational with numerous general or special purpose computing system environments or configurations. For example, the system includes a computer 2302 coupled to a color-imaging device 2100 of FIG. 21. The computer is a personal computer, workstation, server, mainframe, image copier, image scanner, video camera, or other device that is configured to communicate with image forming devices.

The computer 2302 operates in accordance with computer-program instructions associated with at least one application 2304 that outputs image data (e.g., image data 2322) representing a color image suitable for subsequent use by the imaging device 2100. The application 2304 represents one or more sets of software instructions and can include operating system instructions, user application instructions, communication instructions, peripheral driver instructions, color image generation and/or color image manipulation instructions, and any other instructions required to operate the computer within the color imaging system 2300. The application is provided in one or more conventional memories (not shown) that are read or otherwise accessed by the computer.

The computer 2302 is connected to the imaging device 2100 through a data communications path 2306. The data communications link includes requisite communication resources to transport image data and control data between the computer and the imaging device. For example, the communication path may include one or more interface connections, local area networks (LANs), wide area networks (WANs), intranets, the Internet, or other like communication services/systems.

As discussed above in reference to FIG. 21, the imaging device 2100 includes a processor 2130 configured to control the operations associated with various subsystems and computer-program modules therein while forming color images on print media. Specifically, the processor is coupled to a memory 2308 that includes computer program applications 2310 and data 2312. Exemplary memories include nonvolatile memory (e.g., flash memory, EEPROM, and/or read-only memory (ROM)), random access memory (RAM), and hard disk and associated drive circuitry.

The processor 2130 is configured to fetch and/or read computer-executable instructions 2310 and/or data 2312 respectively to/from the memory 2308 to render color images. The computer-executable instructions include an image data conversion module 2314, a halftoner module 2316, and a printing module 2318. The printing module includes a printhead-servicing module 2320 to move staggered printheads (e.g., printheads 1312 of FIGS. 12 and 14) to/from the print zone (e.g., print zone 1402 of FIG. 14, and print zone 2135 of FIG. 21) from/to a printhead servicing module (e.g., see service module 2320 of FIG. 23, and service module 2144 of FIG. 21). Although these modules are described separately these module can be combined in any number of different program module combinations.

Color image data 2320 is received from the computer 2302 over communication path 2306, and provided to the conversion module 2314. The color image data typically includes one or more various image objects such as text objects, graphics objects, and/or raster data objects, as defined by conventional desktop publishing techniques and/or tools. In this example, the color image data is in RGB data format. However, the exemplary arrangements and procedures of this description to move staggered printheads between a print zone and a printhead servicing module can be applied to image data received from a computer that is in data formats other than RGB, such as CMYK data formats, and so on.

If the image data 2320 from the computer 2302 is not already in a printable data format, the image data conversion module 2314 uses a color table (not shown) to convert the color image data into corresponding print image data 2324 that is output to the halftoning module 2316. The print data includes 8-bits of data for each ink color (i.e., cyan (C), magenta (M), yellow (Y), and black (K)), for each pixel in the corresponding color image. Thus, 32-bits of print data define the overall color of each pixel in the print image.

The halftoning module 2316 renders gray levels of image data pixel color. Halftoning is a threshold operation to simulate a gray level by replacing some fraction of pixels with 0% ink and some fraction of pixels with 100% ink and some fraction of pixels with an intermediate level of ink. This produces a dot pattern at a resolution less than the pixel resolution of the printer. The halftoning module supplied the halftoned print data 2324 to the color image-rendering module 2318.

The printing module 2318 uses the print image data 2324 to selectively apply an appropriate amount of ink, such as, for example, cyan (C) ink, magenta (M) ink, yellow (Y) ink, or black (K) ink, to a print media to form a corresponding plane of printed image. Multiple staggered printheads (e.g., the printheads 1312 of FIG. 21) provide the ink. As the image is being formed on the print medium, the printhead-servicing module 2322 moves the staggered printheads between a print zone and the imaging device's printhead servicing module.

An Exemplary Procedure to Service Staggered Printheads

Figure 24:
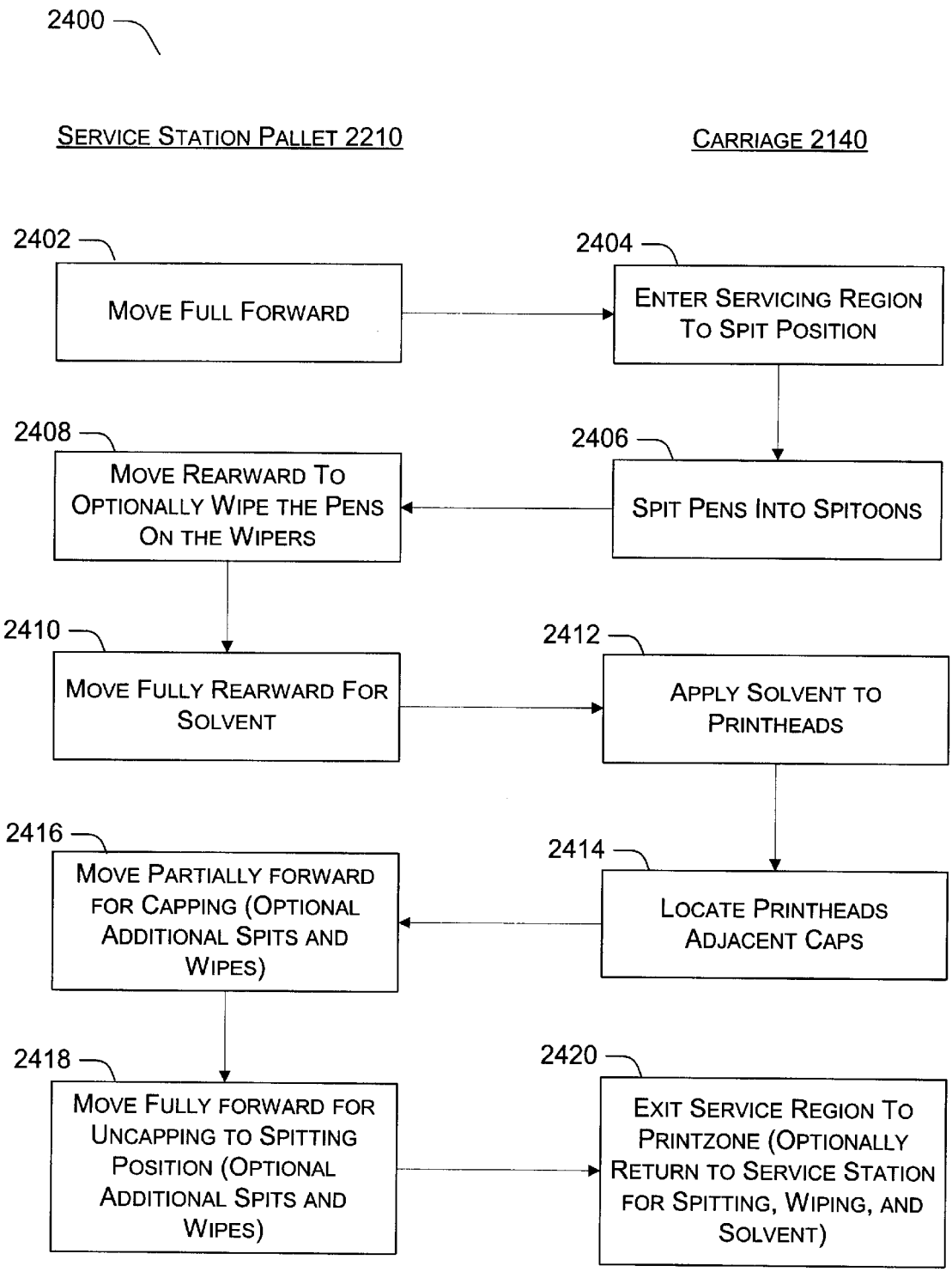
FIG. 24 is a flow diagram illustrating aspects of an exemplary operation of the replaceable service station to service the staggered printheads installed in a carriage.

FIG. 24 is a flow diagram illustrating aspects of an exemplary operation of the replaceable service station 1300 to service the staggered printheads 1312 installed in carriage 2140. In the flow diagram of FIG. 24, the blocks in the left column all refer to motion of the service station pallet 2210 (see, FIG. 22), while the blocks in the right column all refer to motion of the printhead carriage 2140 along the scanning axis 2138 (see, FIG. 21). Motion of both the service station pallet and the carriage are in response to control signals received from the imaging device controller 2130. Here, the servicing routine 2400 begins following completion of a print job, with the carriage being located in the print zone 2135.

At block 2402, the service station pallet is moved in direction 2416 to a forward position (e.g., indicated in FIG. 24 as "2216"). At block 2404, the carriage 2140 enters the servicing region 2142. At this point, the carriage 2140 has positioned the printheads 1312 over corresponding spittoons 1310. The horizontal arrows 1404–1412 of FIG. 14 illustrate this motion to/from the print zone 1402. The spitting position is shown in FIG. 16 with a side view of a printhead in a spitting position. At block 2406, the pens then spit black ink and color ink respectively into the spittoons.

At block 2408, the service station pallet 2410 may optionally move rearward 2218 from the spittoon area 1310 to wipe the printheads clean of any ink residue on corresponding wiping units 1308—as also illustrated in FIGS. 17 and 18. Following this optional wiping operation, at block 2410 the service station pallet 2410 then moves to a full rearward 2218 position such that solvent wicks 1306 are pressing against the leading edge of respective staggered printheads 1312. At 2412, the carriage engages the solvent nibs at each printhead for solvent. Following the solvent application, the spitting 2406 and wiping operations 2408 may optionally be repeated.

At block 2414, the carriage then locates the printheads 1312 adjacent the caps 1302 for sealing. This movement is shown in FIG. 14 with the zigzag arrows from the spitting region 1310 to the capping region 1302. A side view of a capped printhead is shown in FIG. 15. At block 2416, the service station pallet 2410 moves partially forward to cap the printheads.

To ready the printheads 1312 for printing, block 2418 is performed, where the service station pallet 2410 moves in a fully forward direction 2416 to uncap the printheads. As a portion of this uncapping operation, optionally the printheads may be spit as described above, and this spitting may be followed by an optional wiping operation as described above. After uncapping the printheads 1312, at block 2420, the carriage 2140 may exit the servicing region 2142 and enter the print zone 2135 to perform a print job. At block 2414, the service station pallet 2410 is moved in the rearward direction 2418 to a rest position to conclude the printhead servicing routine.

During the printing process the carriage 2136 may again move the staggered printheads 1312 to the servicing region 2142 for optional spitting, wiping, and solvent as discussed above.

Conclusion

Although the subject matter has been described in language specific to structural features and/or methodological operations, it is to be understood that the subject matter defined in the appended claims is not necessarily limited to the specific features or operations described. For example, the zigzag arrow 1314 of FIG. 13 shows the relative motion of a printhead to/from a capping unit 1302 relative to the position of the spittoon reservoir 1310. Instead of a zigzag motion, the spittoon's width is enlarged to allow a straight motion to/from the capping station to/from the spittoon. Thus, the specific features and operations are disclosed as preferred forms of implementing the claimed features.

What is claimed is:

1. A color inkjet imaging device including a plurality of staggered printheads, the color inkjet imaging device comprising:

a plurality of cleaning units coupled to a service station, each cleaning unit comprising a plurality of components to service a particular one printhead of the staggered printheads, each cleaning unit being offset from an adjacent cleaning unit to form a staggered cleaning unit configuration, each cleaning unit comprising a proximal and a distal end, and wherein the components comprise a spittoon at the distal end, a wiper at the proximal end, a capping region at the proximal end, and a solvent dispenser at the proximal end, the wiper being positioned adjacent to the capping unit, the capping unit being offset from center with respect to the spittoon region, the capping unit comprising a long and a short axis, a first end of the long axis being positioned adjacent the spittoon region, and a second end of the long axis unit being collinear and adjacent to the solvent dispenser.

2. An inkjet printhead cleaning unit comprising:

a proximal and a distal end; and a plurality of components to service a particular one printhead of a plurality of staggered printheads, the components comprising a spittoon at the distal end, a wiper at the proximal end, a capping region at the proximal end, and a solvent dispenser at the proximal end, the wiper being positioned adjacent to the capping unit, the capping unit being offset from center with respect to the spittoon region, the capping unit comprising a long and a short axis, a first end of the long axis being positioned adjacent the spittoon region, and a second end of the long axis unit being collinear and adjacent to the solvent dispenser.

3. An inkjet printhead cleaning unit as recited in claim 2, wherein the particular one printhead is selected from a cyan ink printhead, a magenta ink printhead, a yellow ink printhead, or a black ink printhead.

4. In a color inkjet imaging device, a method to service a plurality of staggered printheads, the method comprising:

moving a service station pallet to a forward position, the service station comprising a plurality of staggered printhead cleaning units, each of the cleaning units comprising a respective spittoon reservoir;

repositioning the staggered printheads into the service station such that each printhead is over a corresponding spittoon reservoir;

spitting, by the printheads, ink into corresponding spittoon reservoirs; and wherein the cleaning units comprise a wiper a solvent dispenser, and a capping unit, the wiper being positioned adjacent to the capping unit, the capping unit being offset from center with respect to the spittoon region, the capping unit comprising a long and a short axis, a first end of the long axis being positioned adjacent the spittoon region, and a second end of the long axis unit being collinear and adjacent to the solvent dispenser.

5. A method as recited in claim 4, wherein the staggered printheads further comprise a cyan ink printhead, a magenta ink printhead, a yellow ink printhead, and/or a black ink printhead.

6. A method as recited in claim 4, wherein the cleaning units further comprise a proximal and a distal end, each respective spittoon reservoir being at the distal end of a corresponding cleaning unit, the cleaning units further comprising a wiper at the proximal end, and wherein the method further comprises moving the service station pallet rearward to wipe each of the printheads clean of any ink residue on a corresponding wiper.

7. A method as recited in claim 4, wherein the cleaning units further comprise a proximal and a distal end, the spittoon being at the distal end, the cleaning units further comprising a wiper at the proximal end and a solvent dispenser at the proximal end, and wherein the method further comprises:

moving the service station pallet to a full rearward position such that corresponding solvent wicks are pressing against leading edges of respective staggered printheads; and delivering solvent to the staggered printheads.

8. A method as recited in claim 4, wherein the cleaning units further comprise a proximal and a distal end, the spittoon being at the distal end, the cleaning units further comprising a wiper at the proximal end, a solvent dispenser at the proximal end, and a capping region at the proximal end, and wherein the method further comprises:

moving the service station pallet to a printhead capping position; and sealing each of the staggered printheads.

9. A computer-readable medium to service a plurality of staggered printheads in a color inkjet imaging device, the computer-readable medium comprising computer-executable instructions for:

moving a service station pallet to a forward position, the service station comprising a plurality of staggered printhead cleaning units, the cleaning units comprising a spittoon reservoir;

repositioning the staggered printheads into the service station such that each printhead is over a corresponding spittoon;

spitting, by the printheads, ink into the corresponding spittoons; and wherein the cleaning units comprise a wiper a solvent dispenser, and a capping unit, the wiper being positioned adjacent to the capping unit, the capping unit being offset from center with respect to the spittoon region, the capping unit comprising a long and a short axis, a first end of the long axis being positioned adjacent the spittoon region, and a second end of the long axis unit being collinear and adjacent to the solvent dispenser.

10. A computer-readable medium as recited in claim 9, wherein the staggered printheads further comprise a cyan ink printhead, a magenta ink printhead, a yellow ink printhead, and/or a black ink printhead.

11. A computer-readable medium as recited in claim 9, wherein the cleaning units further comprise a proximal and a distal end, the spittoon being at the distal end, the cleaning units further comprising a wiper at the proximal end, and wherein the computer-executable instructions further comprise instructions for moving the service station pallet rearward to wipe each of the printheads clean of any ink residue on a corresponding wiper.

12. A computer-readable medium as recited in claim 9, wherein the cleaning units further comprise a proximal and a distal end, the spittoon being at the distal end, the cleaning units further comprising a wiper at the proximal end and a solvent dispenser at the proximal end, and wherein the computer-executable instructions further comprise instructions for:

moving the service station pallet to a full rearward position such that corresponding solvent wicks are pressing against leading edges of respective staggered printheads; and delivering solvent to the staggered printheads.

13. A computer-readable medium as recited in claim 9, wherein the cleaning units further comprise a proximal and a distal end, the spittoon being at the distal end, the cleaning units further comprising a wiper at the proximal end, a solvent dispenser at the proximal end, and a capping region at the proximal end, and wherein the computer-executable instructions further comprise instructions for:

moving the service station pallet to a printhead capping position; and sealing each of the staggered printheads.

* * * * *